United States Patent [19]

Coleman

[11] 4,093,016

[45] * June 6, 1978

[54] CURTAIN COATING METHOD AND APPARATUS AND THE MANUFACTURE OF PAPERBOARD

[75] Inventor: John Douglas Coleman, Surrey Hills, Australia

[73] Assignee: Commonwealth Scientific and Industrial Research Organization, Campbell, Australia

[ * ] Notice: The portion of the term of this patent subsequent to Feb. 15, 1994, has been disclaimed.

[21] Appl. No.: 709,068

[22] Filed: July 27, 1976

Related U.S. Application Data

[62] Division of Ser. No. 477,380, Jun. 7, 1974, Pat. No. 3,992,252.

[30] Foreign Application Priority Data

Jun. 7, 1973 Australia ..... 3579/73

[51] Int. Cl.[2] ..... D21F 11/00

[52] U.S. Cl. ..... 162/124; 162/175; 162/186

[58] Field of Search ..... 162/135, 127, 133, 298, 162/299, 300, 266, 119, 322, 265, 124, 186; 427/420; 118/DIG. 4

[56] References Cited

U.S. PATENT DOCUMENTS

| | | | |
|---|---|---|---|
| 1,859,652 | 5/1932 | Bullerjahn | 427/420 |
| 2,026,594 | 1/1936 | Richter | 162/124 |
| 2,286,924 | 6/1942 | Nicholson | 162/124 |
| 2,703,760 | 3/1955 | Cunning | 118/DIG. 4 |
| 3,359,941 | 12/1967 | Sible | 118/DIG. 4 |

*Primary Examiner*—S. Leon Bashore
*Assistant Examiner*—Peter Chin
*Attorney, Agent, or Firm*—Sughrue, Rothwell, Mion, Zinn and Macpeak

[57] ABSTRACT

A coating of liquid starch is applied to a travelling paper web by an application comprising an elongate hollow box structure having a horizontal slot outlet along one side. Starch solution is forced from the chamber horizontally through the slot outlet then flows downwardly under gravity across an upright wall surface to establish a falling curtain of the starch solution. The wall surface terminates at a bottom blade edge and the curtain falls away from the surface at the blade edge to drop onto the paper web.

2 Claims, 4 Drawing Figures

CURTAIN COATING METHOD AND APPARATUS AND THE MANUFACTURE OF PAPERBOARD

This is a division of application Ser. No. 477,380 filed June 7, 1974, now U.S. Pat. No. 3,992,252.

BACKGROUND OF THE INVENTION

1. Field of the Invention

This invention provides a method and apparatus for producing a falling curtain of liquid. This particular method and apparatus has been developed to provide a technique for the application of starch solution to the plies of multi-ply paperboard and the invention also extends to methods and apparatus for the manufacture of paperboard using this technique.

2. Description of Prior Art

The paperboard industry is heavily committed to the use of wastepaper. More than half the total furnish of boxboards and container liner grades is reclaimed fibre. Included in any bulk collections of wastepaper there is a proportion of high yield pulps which cannot be separated economically and which adversely affect certain stock properties and starches are frequently employed to improve the performance of grades such as a container liner manufactured from such stocks.

The usual manner of applying starch to strengthen multi-ply paperboard is with the aid of a size press in the dryer section of the board forming machine. The partially dried multi-ply board is passed through the size press where it absorbs the starch solution. This operation also increases the moisture content of the board and adds to the drying load imposed on the remainder of the drying section of the paper board machine. In view of the marked increase in bursting strength achieved by the starch addition, however, paper mills are prepared to accept this additional drying load which reduces output.

The addition of 5% starch directly to the furnish would produce possibly 5 to 10% increase in bursting strength of the final product. The addition of further starch has little effect on strength. By comparison the application of 2 to 3% starch at a size press located in the drying section of a paper board machine can yield a 15 to 20% increase in burst strength. The starch additions in each case are calculated as a percentage of total fibre content. It has been observed however that the starch at the size press penetrates only the outer plies of the board and the gains in strength per ply actually penetrated may be more than twice that achieved with addition to the furnish. It follows that if the plies could be effectively treated with starch individually the total burst increment could be increased very significantly or alternatively advantage could be taken of the enhanced effectiveness of the starch to reduce the amount of raw material used, to increase productivity through higher machine speeds, or to make use of lower strength wastepaper.

During the formation of multi-ply paperboard on high speed formers such as the Inverform type, successive plies are exposed for a brief period as the board is built up which provides the opportunity to apply starch successively to the individual plies and the curtain coater of the present invention has been developed for this purpose. Its use is not limited to this particular purpose, however, and it may find application in other fields.

SUMMARY OF THE INVENTION

According to the invention there is provided apparatus for establishing a steady falling curtain of liquid comprising a hollow structure defining a liquid receiving chamber, liquid inlet means for forced flow of liquid into the chamber, a horizontal slot outlet for flow of liquid from the chamber and a wall portion of said structure which defines an external upright surface extending downwardly from the slot outlet and which terminates at a bottom blade edge, whereby in use of the apparatus liquid is forced from the chamber through the slot transversely of said surface then flows down said surface to establish a falling curtain of liquid which drops away from said surface at said blade edge.

The top of the chamber may be vented to atmosphere but in operation there should be a head of liquid above the slot to provide a forced flow through the slot.

The invention also provides a method of establishing a falling curtain of liquid, comprising the steps of forcing the liquid through a horizontal slot so that it wets both upper and lower edges of the slot and is extruded generally horizontally from the slot, allowing the liquid issuing from the slot to fall downwardly under gravity across an upright surface of a wall which terminates at a bottom blade edge to establish a falling curtain of the liquid over the surface which is thinner than the vertical width of the slot and allowing the established curtain to fall away from said surface at the blade edge.

The invention further provides a method of making a multi-ply paper board comprising the steps of forming a first ply and building further plies onto the first ply, wherein a starch solution is applied to at least one of the ply surfaces onto which the further plies are formed and before the respective further ply is formed, the starch solution being applied to said ply surface by the technique of forcing the starch solution through a horizontal slot so that it wets both upper and lower edges of the slot and is extruded generally horizontally from the slot allowing the starch solution issuing from the slot to fall downwardly under gravity across an upright surface of a wall which terminates at a bottom blade edge to establish a falling curtain of starch solution over the surface which curtain is thinner than the vertical width of the slot and allowing the established curtain to fall away from said surface at the blade edge and thence onto said ply surface.

The invention also extends to apparatus for the maufacture of multi-ply paperboard comprising a carrier web, means to drive the carrier web in a forward direction, a first paper pulp depositing device to deposit a layer of paper pulp on the web to form a first ply, further paper pulp depositing devices spaced along the carrier web in the forward direction and operable to deposit further layers of paper pulp to build further plies and in advance of one or more of the further pulp depositing devices in the direction of travel of the carrier web, a starch applicator to apply starch solution to the ply surface on which the particular further pulp depositing device is to deposit a further layer of pulp, the or each starch applicator comprising a hollow structure defining a chamber to receive starch solution, inlet means for forced flow of starch solution into the chamber, a horizontal slot outlet for flow of starch solution from the chamber and a wall portion of said structure which defines an external upright surface extending downwardly from the slot outlet and which terminates at a bottom blade edge such that, in use of the apparatus, starch solution is forced from the chamber through the slot outlet transversely of said surface then flows down said wall surface to establish a falling curtain of starch solution which falls away from said wall surface of said blade edge to drop onto said ply surface.

In order that the invention may be more fully explained its application to a high speed Inverform machine will now be described in detail with reference to the accompanying drawings.

Figure 2:
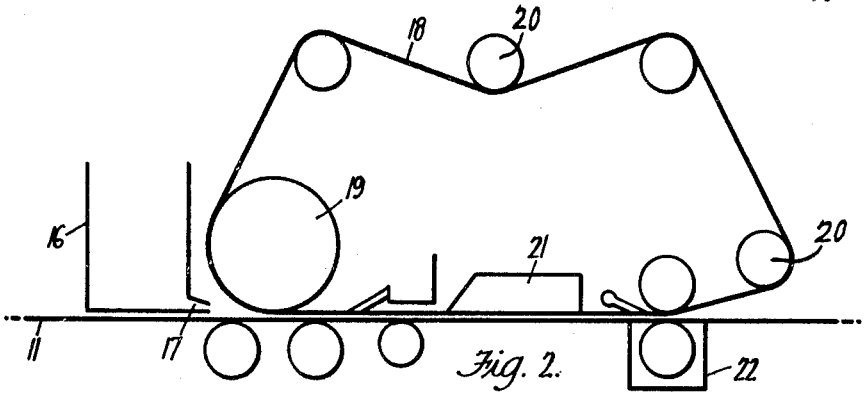
FIG. 2 is an enlarged horizontal elevation of one stage in the Inverform machine.

The illustrated Inverform machine manufactures a board consisting of four paper plies. The machine has an endless carrier web 11 driven continuously through a loop around support rollers 10 by drive means (not shown). The machine comprises four ply-forming stages 12, 13, 14, 15. Each of these has the general construction which is illustrated in more detail in FIG. 2. As seen in this figure a flow box 16 is located directly above the carrier web 11 to deposit pulp onto the carrier through slot outlet 17. The deposited layer of pulp is held between carrier web 11 and a further web or "top wire" 18 as it passes beneath a forming roller 19 and between upper and lower vacuum boxes 21, 22 by means of which it is dewatered to form a consolidated ply. The "top wire" 18 moves around a closed loop supported on rollers 20. An auto-slice 8 and a suction slice 9 are also provided in each stage.

In each stage the top wire 18 is driven through an endless loop and it comes away from the ply at the end of this stage. Thus, the upper surface of the ply formed in each of the first three stages is exposed briefly before entering the next ply-forming stage of the machine. In accordance with the present invention starch is deposited on the exposed ply surfaces between the successive forming stages with the result that the starch is applied between the successive plies and can penetrate all of the plies rather than only the outer two as in the conventional size press method.

Figure 1:
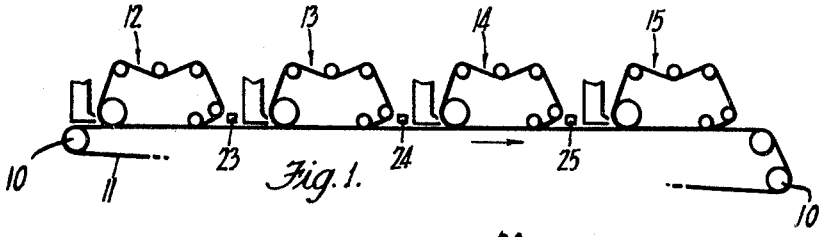
FIG. 1 is a diagrammatic elevation of a modern high speed Inverform machine which has been modified by the addition of curtain coaters for application of starch between present plies in accordance with the resent invention.
Figure 3:
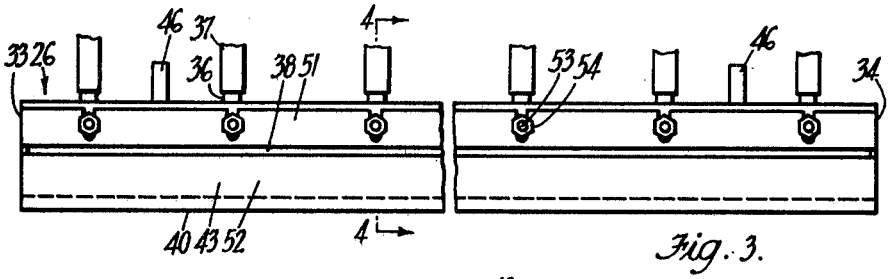
FIG. 3 is an elevation of one of the curtain coaters.
Figure 4:
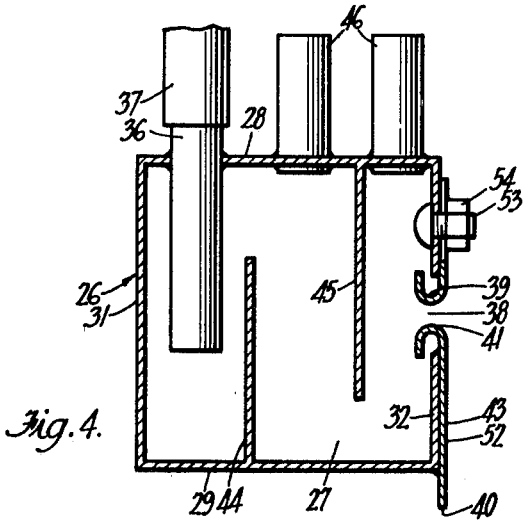
FIG. 4 is a cross-section on the line 4—4 in FIG. 3.

The starch is deposited by means of curtain coaters indicated in FIG. 1 as 23, 24, 25. They are of identical construction, this construction being illustrated in FIGS. 3 and 4. Each comprise a horizontal elongate hollow structure 26, the interior of which serves as a liquid receiving pressure chamber 27. Structure 26 may be made from sheet metal as a long box of rectangular cross-section. It has top and bottom walls 28, 29, side walls 31, 32 and end walls 33, 34. Chamber 27 may be about 2 inches wide by 2 inches deep in a typical structure 26 would need to be about 15 feet long or even more.

The top wall 28 of structure 26 is provided with liquid inlet tappings 36 to which liquid supply pipes 37 are connected. Tappings 36 and pipes 37 together form liquid inlet ducts which extend downwardly into chamber 27 at locations adjacent side wall 31 and therefore remote from side wall 32. Inlet tappings 36 are spaced at regular intervals throughout the length of structure 26. Inlet pipes 37 are supplied with liquid starch under pressure. Pipes 37 may, for example, be be branches of a single supply manifold.

Side wall 32 of structure 26 is provided with a horizontal slot outlet 38 defined between upper and lower lips 39, 41 formed on upper and lower plates 51, 52 fastened to the outerface of wall 32. Upper plate 51 is fastened to wall 32 by studs 53 and into 54 so that the position of upper lip 39 can be adjusted to vary the width of the slot outlet whereas lower plate 52 is permanently fixed to wall 32 by welding or a suitable adhesive. Lips 39, 41 are rounded, being formed by suitably curving the respective margins of plates 51, 52. Plate 52 defines an external upright surface 43 extending downwardly from lower lip 41 of slot outlet. It extends below the bottom wall 29 of structure 26 to terminate in a sharp blade edge 40 at the bottom of surface 43.

Vertical baffle plates 44, 45 are fitted within structure 26 to obstruct direct flow of liquid from inlet tappings 36 to the outlet slot 38. More particularly baffle 44 extends upwardly from the bottom wall 29 adjacent tappings 36 to an upper edge which is above the bottom ends of the tappings. Baffle 45 extends downwardly from top wall 28 adjacent slot 38 to a lower edge below the level of the slot. The starch pumped into the chamber via tappings 38 is therefore caused to flow in a sinuous path to reach slot 38.

Vent pipes 46 are fitted to the upper wall 28 of structure 26 to vent the upper part of the chamber 27 to atmosphere.

Liquid starch is metered by pumping into chamber 27 under pressure and fills the chamber to a level above slot outlet 38. The liquid in the chamber thus forms a pressure head causing starch to wet both the upper and lower lips 39, 41 of the slot and to be extruded horizontally outwardly through slot 38 whereupon it falls down the vertical surface 43 to establish a thin falling curtain. It is found that surface tension effects due to the wetting of the upper slot lip 39 and the wall surface 43 produces a marked thinning of the extruded body of starch solution and the curtain which is established on surface 43 is much thinner than the vertical width of the slot — i.e. the distance between the upper and lower slot lips 39, 41. This thin curtain or film falls away from the surface 43 at the sharp blade edge 40 to drop from the coater as a free falling curtain.

Starch is a particularly difficult liquid with which to form a steady free falling curtain since it can be very variable in consistency and viscosity and will often be contaminated with lumps and impurities which would clog narrow openings. If a conventional open overflow weir type coater is used the curtain becomes interrupted on changes of viscosity and consistency or by formation of films caused by evaporation. Moreover open overflow weir coaters must be very accurately levelled whereas the illustrated coater has considerable tolerance to misalignment. If a conventional extruder type coater extruding downwardly through an outlet slot is used the slot must be so narrow that it becomes difficult to manufacture and set over the long lengths required in paper making and furthermore it would become clogged very rapidly. In the illustrated coater the liquid is metered to minimise the effects of variations in viscosity and consistency but because the liquid is extruded horizontally a much wider outlet slot is used than in the convention extrusion coaters. Surface tension effects in combination with the horizontal extrusion enable an accurately controlled low volume flow which enables very thin films to be formed. The rounding of upper slot lip 39 assists in maintaining a film of constant thickness in that it minimises random variations in the wetted surface area at the lip which might otherwise upset the surface tension balance in the zone where the film is formed. The sharp blade edge 40 at the bottom of the surface 43 ensures that the film can fall away cleanly even though it is very thin and would tend to adhere to or run around a less sharp corner.

One particular apparatus constructed in accordance with the invention uses oxidised starch solution having 9% solids concentration and a viscosity of 30 seconds Steinhall cup at 18° C. The slot outlet is ⅛ inch wide and its upper and lower lips are rounded to 3/16 inch diameter curvature. The starch solution is applied at a rate of 1 gallon/minute per foot width of coating onto a paper web travelling at 800 ft/minute. This apparatus has operated most satisfactorily to give a stable film and an acceptable starch concentration in the fibres of the web. Generally in order to ensure satisfactory results the slot outlet may be in the range 1/16 inch to ½ inch with a minimum flow rate of about 0.6 gallons/minute per foot width of coating. The starch viscosity may be in the range 18 seconds to 45 seconds Steinhall cup at 20° C and the apparatus should handle starch concentrations up to 10% when appropriately oxidised.

The coater is usually disposed with the outlet slot 38 facing in the direction of travel of the web and it may be tilted slightly so that surface 43 is not quite vertical but is inclined at an angle of approximately 10° to the vertical to minimise air entrainment and stress in the film and thereby promote smooth application of the film to the moving ply surface.

Athough in the above described specific process for manufacturing paperboard, starch is applied between each successive pair of plies this is not absolutely essential and starch could be applied between selected plies only. For example, in the manufacture of a 5-ply paperboard starch could be applied between the second and third plies and between the third and fourth plies only. Moreover, as previously mentioned, curtain coaters of the illustrated type may be used for purposes other than the application of starch to paper plies in board-forming machinery. They could, for example, be used for applying a coating slip film to a board to provide a fine lustre and a surface finish which will enable high quality printing. It is accordingly to be understood that the invention is in no way limited to the details of the specific apparatus and methods described above and that many modifications and variations will fall within the scope of the appended claims.

I claim:

1. A method of making multi-ply paperboard comprising the steps of depositing paper pulp onto a forwardly travelling carrier web at locations spaced along the carrier web to form successive superimposed paper plies and applying starch solution to the upper surface of at least one of the plies onto which a succeeding ply is superimposed and before said succeeding ply is formed; the starch solution being applied to said ply surface by the technique of introducing a forced flow of starch solution into a chamber which is disposed above the carrier web in advance of the location at which said succeeding ply is to be formed and which has an upright side wall with a horizontal slot outlet of vertical width in the range of 1/16 inch to ½ inch, maintaining the forced flow of starch solution into the chamber whereby in the vicinity of the slot outlet the starch solution is maintained within the chamber at a level above the upper edge of the slot outlet such that the starch solution is extruded horizontally from the slot outlet as a horizontal stream contacting both the upper and lower edges of the slot outlet and of thickness determined by the vertical width of the slot outlet, allowing the stream issuing from the slot outlet to fall downwardly under gravity across an upright surface which terminates at a bottom blade edge at a distance below said horizontal slot outlet such that the falling starch solution forms a continuous curtain which is attenuated as it flows down said upright surface to a thickness less than that of the horizontal stream extruded from said slot outlet, and allowing the attenuated continuous curtain to fall away from said upright surface at the blade edge and to drop onto said ply surface.

2. A method as claimed in claim 1, wherein the flow rate of starch solution is at least 0.6 gallons per minute per foot width of coating on said ply surface and the viscosity of the starch solution is in the range 18 seconds to 45 seconds Steinhall Cup at 20° C.

* * * * *